US005183480A

United States Patent [19]

Raterman et al.

[11] Patent Number: 5,183,480

[45] Date of Patent: Feb. 2, 1993

[54] APPARATUS AND METHOD FOR COLLECTING PARTICULATES BY ELECTROSTATIC PRECIPITATION

[75] Inventors: Michael F. Raterman, Doylestown, Pa.; Michael D. Thiel, Fairfax, Va.

[73] Assignee: Mobil Oil Corporation, Fairfax, Va.

[21] Appl. No.: 783,472

[22] Filed: Oct. 28, 1991

[51] Int. Cl.[5] ..... B03C 3/49; B03C 3/76

[52] U.S. Cl. ..... 55/12; 55/13; 55/113; 55/121; 55/154

[58] Field of Search ..... 55/12-14, 55/109, 113, 121, 154, 156; 423/215.5, 210; 422/139; 208/152, 113, 161, 163

[56] References Cited

U.S. PATENT DOCUMENTS

| | | | |
|---|---|---|---|
| 1,396,811 | 11/1921 | Chubb | 55/14 |
| 2,582,133 | 1/1952 | Karlsson | 55/113 X |
| 3,785,117 | 1/1974 | Leith | 55/12 X |
| 3,985,524 | 10/1976 | Masuda | 55/154 X |
| 4,029,485 | 6/1977 | Siwersson et al. | 55/113 |
| 4,363,723 | 12/1982 | Knoll et al. | 55/154 X |
| 4,853,107 | 8/1989 | Haddad et al. | 208/152 |

FOREIGN PATENT DOCUMENTS

| | | | |
|---|---|---|---|
| 479015 | 7/1929 | Fed. Rep. of Germany | 55/121 |
| 947642 | 7/1949 | France | 55/14 |
| 52-13176 | 2/1977 | Japan | 55/121 |

OTHER PUBLICATIONS

Kirk-Othmer, Encyclopedia of Chemical Technology, Third Edition, vol. 1, John Wiley & Sons, pp. 673-685.

*Primary Examiner*—Richard L. Chiesa
*Attorney, Agent, or Firm*—Alexander J. McKillop; Charles J. Speciale; Laurence P. Hobbes

[57] ABSTRACT

An electrostatic precipitator apparatus and method which minimizes reentrainment of collected particles during their removal from the collecting electrode by use of a collecting system including concentric semi-tubes which are configurable from a position exposed to gas flow to one protected therefrom.

20 Claims, 1 Drawing Sheet

APPARATUS AND METHOD FOR COLLECTING PARTICULATES BY ELECTROSTATIC PRECIPITATION

FIELD OF THE INVENTION

This invention relates to an apparatus and method for collecting particulates from a gaseous stream by electrostatic precipitation. More particularly, this invention relates to an apparatus and method for collecting and removing extremely small catalyst particles ("fines") from fluidized catalytic cracking (FCC) catalyst inventory by electrostatic precipitation onto a charged collector surface, while minimizing their reentrainment during removal from the collector surface.

BACKGROUND OF THE INVENTION

Electrostatic precipitators can collect either solid or liquid particulates very efficiently, particularly those smaller than 2 microns. In a precipitator, particles are charged in an electric field and move to a surface of opposite charge where they are deposited. Precipitators exhibit low pressure drops, low consumption of electrical power, and low operating costs. Moreover, they recover particulates in agglomerated form, rendering them more easily collectible in case of reentrainment.

Electrostatic precipitators are often used for removing dust from gases of low conductivity, such as flue gas, gaseous effluents from cement or gypsum calcination operations or refinery process streams. Single-stage precipitation systems, commonly known as "Cotrell precipitators," are used for dust or mist collection in treating various industrial process gases. The collecting electrodes used may be parallel plates, screens, etc., or may be pipes, with the discharge electrodes being placed between the plates or within the pipes. U.S. Pat. No. 4,853,107 to Haddad et al. discloses the use of electrostatic precipitators for separating catalyst fines from the flue gas of fluidized catalytic cracking (FCC) units. Electrostatic precipitators, both single stage and two-stage, are further discussed in Kirk-Othmer, Encyclopedia of Chemical Technology, John Wiley & Sons, Third Ed., Vol. 1 at pp. 673–685 (1978).

One problem associated with electrostatic precipitators is the reentrainment of particulates in the flue gas when they are displaced from collecting electrodes, by application of sonic energy or mechanical rapping. In order to minimize reentrainment, the collecting surface should be struck by a force of proper intensity to snap the dust cake formed on the collecting electrode loose and allow it to slide down in cake form into a dust hopper from which it can be collected. Such reentrainment has been further minimized by adding baffles to collecting electrode plates in order to keep the bulk of the flue gas away from the dust cake and provide a quiescent zone for dust to slide downward during rapping. However, such arrangements can impair the flow of gas resulting in unacceptable pressure drop. U.S. Pat. No. 4,029,485 to Siwersson et al. teaches an electrostatic gas cleaner having collecting electrodes mounted concentrically around the discharge electrodes which collecting electrodes are rotated in order to throw off collected particles within a casing not influenced by the gas flow between discharge and collecting electrodes.

All of the above-mentioned publications are incorporated herein by reference.

SUMMARY OF THE INVENTION

The present invention relates to an electrostatic precipitator which minimizes reentrainment of collected particles during their removal from the collecting electrode by means of a collecting means comprising said electrode which is configurable from a position exposed to gas flow to one protected therefrom.

The present invention encompasses both single stage and two-stage embodiments of electrostatic precipitators.

In one aspect, the present invention relates to an apparatus for collecting particulates from a flowing gaseous stream containing particulates by electrostatic precipitation which comprises:

i) a gas inlet;

ii) a gas outlet;

iii) a discharge electrode for electrically charging said particulates;

iv) a particulate collecting means which comprises outer and inner concentric, nestable, semi-tubes, each of which is rotatable relative to the other from an open, nested configuration, to a substantially enclosed tube configuration having a lower end which communicates with a particulate collection receptacle, said inner semi-tube having a concave surface acting as a collecting electrode which is oppositely charged from said discharge electrode, to attract and hold said charged particulates;

v) a means for removing said particulates from said collecting electrode by subjecting said concave surface to conditions which detach said particulates therefrom;

vi) a means for forcing said gaseous stream from said gas inlet past said discharge electrode and said collecting means to said gas outlet; and vii) a voltage source means to apply a voltage to said discharge and collecting electrodes.

In another aspect, the present invention relates to a method for reducing catalyst particulate contamination in a flowing gas stream containing particulates wherein said gas is passed through an electrostatic precipitator which method comprises:

i) passing said gas by a discharge electrode thereby electrically charging said particulates;

ii) capturing said charged particulates on a particulate collecting means, proximal to said discharge electrode, which comprises outer and inner concentric, nestable, relatively rotatable, semi-tubes, arrayed in an open, nested configuration, said inner semi-tube having a concave surface exposed to the flow of said gas, acting as a collecting electrode which is oppositely charged from said discharge electrode until a desired amount of particulates have been collected;

iii) rotating said semi-tubes to a substantially enclosed tube configuration having an interior which is not substantially exposed to the flow of said gas, said configuration having a lower end which communicates with a particulate collection receptacle;

iv) subjecting said collecting electrode to forces which detach said particulates from said collecting electrode, said particulates dropping into a particulate collection receptacle from which they can be removed; and v) rotating said semi-tubes from said enclosed tube configuration to said open, nested configuration; and vi) withdrawing a gas stream of reduced particulate contamination.

BRIEF DESCRIPTION OF THE DRAWING

A more complete appreciation of the invention, and many of the attendant advantages thereof, will be readily apparent as the same becomes better understood by reference to the accompanying drawing.

The FIGURE is a perspective view of an embodiment of the apparatus of the present invention which shows the apparatus in both particulate collecting and particulate detaching modes.

DETAILED DESCRIPTION OF THE PREFERRED EMBODIMENTS

Figure 1:
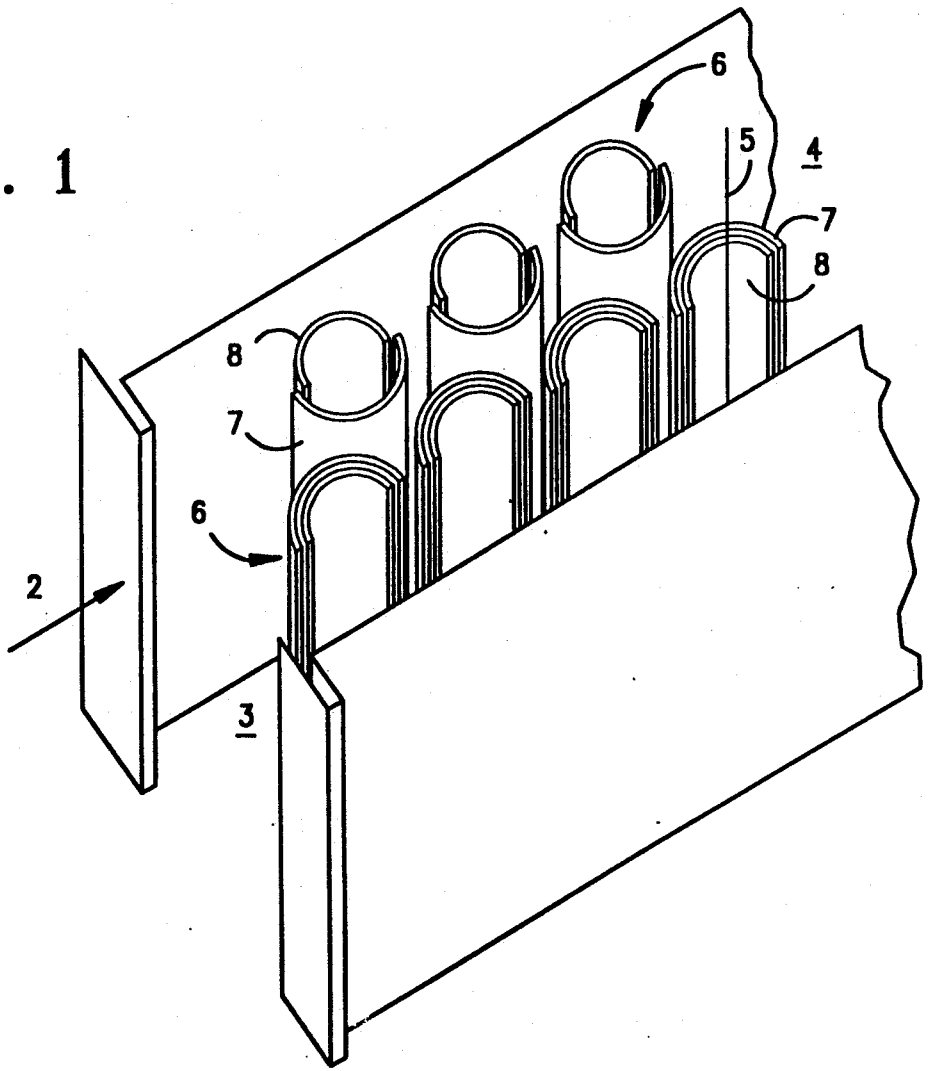

The drawing illustrates one embodiment of the present invention, namely an electrostatic precipitator apparatus 1 which can be disposed in the path of a flowing gaseous stream 2 containing particulates which can range in size from 0.5 to 30 microns, e.g., 2 to 10 micron.

The particulate-containing gaseous stream can be taken from a variety of sources, such as flue gas or gaseous effluents from cement or gypsum calcination operations. In one aspect, effluent from one or more stages of a fluidized catalytic cracking process (FCC) which contains catalyst fines is particularly suited to treatment by the present invention. More particularly, such effluent can be hydrocarbon-containing gas containing catalyst fines which should be removed before passage to a fractionation stage. Alternatively, such effluent can be flue gas from the regenerator which should be treated to remove particulates such as catalyst fines prior to exhausting to the atmosphere.

The electrostatic precipitator apparatus comprises a gas inlet 3 from which particulate-containing gas is introduced to the apparatus and a gas outlet 4 from which gas of reduced particulate content is removed after treatment. The apparatus can comprise a means capable of forcing the gaseous stream from said gas inlet to said gas outlet, e.g. a compressor or blower. Disposed downstream of the gas inlet (or upstream of the gas inlet in the case of two-stage precipitators) is a discharge electrode 5 which serves to effect gas ionization and induce particle charging. A particulate collecting means 6 comprises outer 7 and inner 8 concentric, nestable, semi-tubes, each of which is rotatable relative to the other from an open, nested configuration, to a substantially enclosed tube configuration having a lower end which communicates with a particulate collection receptacle (not shown), said inner semi-tube having a concave surface acting as a collecting electrode which is oppositely charged from said discharge electrode, to attract and hold charged particulates.

A conventional voltage source means (not shown) is employed to apply a voltage to said discharge and collecting electrodes. The discharging and collecting electrodes are preferably negative polarity discharge (gas ionizing) electrodes because higher voltages which improve efficiency can be obtained without sparkover. However, the electrodes can be positive polarity discharge electrodes which avoids the formation of ozone in oxygen-containing gases encountered during use of negative polarity discharge electrodes.

Preferably, the semi-tubes are longitudinally disposed in a substantially vertical configuration in order to allow transport of particulates by gravity when they are eventually removed from the collecting electrode. The semi-tubes are also preferably arranged so that their longitudinal axis is perpendicular to the flow of gas being treated; however, it is also contemplated that the flow of gas can be along the longitudinal axis of said semi-tubes, if so desired. In one embodiment, the discharge electrode 5 is a wire suspended in the center of the semi-tubes which can be tensioned by a weight (not shown) suspended at the bottom of the wire.

As particles build up on the collecting electrode, the efficiency with which particles are removed from the gas flow is decreased, resulting in unacceptable performance. In order to remove the particles so built up, while minimizing entrainment in the gas flow of particles dislodged by such removal, the semi-tubes are rotated relative to the other from the open, nested configuration to a substantially enclosed tube configuration whose interior is substantially protected from the gas flow. Such rotation is preferably accomplished by movement of the inner semi-tube relative to a fixed outer semi-tube, although in alternative embodiments the outer semi-tube are moveable while the inner semi-tube is fixed, or both semi-tubes are moveable.

In order to effect removal of particulates from the collecting electrode, the collecting surface can be struck by a force of proper intensity to snap the built-up particulate matter loose therefrom, allowing it to be passed to the particulate collection receptacle from which it can be removed continually or periodically. In one embodiment, the voltage applied to said collector electrode is interrupted during detaching of particulates therefrom. The force employed can be of any type suitable to effect the desired dislocation of particulate matter from the collecting surface, the simplest of which is mechanical, i.e., "rapping" the collector surface. Alternatively the collecting surface can be exposed to blasts of sonic or ultrasonic energy to effect such dislocation. The dislodged particulate matter is then transferred to a suitable collection receptacle, e.g., a hopper positioned beneath the lower end of the semi-tubes. Where the particulate matter retains economic value, e.g., as a catalyst, it can be recycled from the collection receptacle, e.g., to a catalyst regenerator. Otherwise such particulate matter can be disposed of by conventional techniques.

The effluent withdrawn from the gas outlet which contains reduced amounts of particulate matter can be exhausted to the atmosphere, treated further, or directed to a fractionator depending on its content.

It is claimed:

1. An apparatus for collecting particulates from a flowing gaseous stream containing particulates by electrostatic precipitation which comprises:

i) a gas inlet;

ii) a gas outlet;

iii) a discharge electrode for electrically charging said particulates;

iv) a particulate collecting means which comprises outer and inner concentric, nestable, semi-tubes, each of which is rotatable relative to the other from an open, nested configuration, to a substantially enclosed tube configuration having a lower end which communicates with a particulate collection receptacle, said inner semi-tube having a concave surface acting as a collecting electrode which is oppositely charged from said discharge electrode, to attract and hold said charged particulates;

v) a means for removing said particulates from said collecting electrode by subjecting said concave surface to conditions which detach said particulates therefrom;

vi) a means for forcing said gaseous stream from said gas inlet past said discharge electrode and said collecting means to said gas outlet; and vii) a voltage source means to apply a voltage to said discharge and collecting electrodes.

2. The apparatus of claim 1 wherein said outer and inner concentric, nestable, semi-tubes are substantially vertically disposed.

3. The apparatus of claim 1 wherein said outer semi-tube is fixed and said inner semi-tube is moveable.

4. The apparatus of claim 1 wherein said outer semi-tube is moveable and said inner semi-tube is fixed.

5. The apparatus of claim 1 wherein both said outer and inner semi-tubes are moveable.

6. The apparatus of claim 1 wherein said particulates are detached from said collecting electrode by application of mechanical force.

7. The apparatus of claim 1 wherein said particulates are detached from said collecting electrode by application of sonic energy.

8. The apparatus of claim 1 which is a single-stage precipitator.

9. The apparatus of claim 1 which is a two-stage precipitator.

10. The apparatus of claim 1 wherein said gaseous stream is a flue gas from a fluidized catalytic cracking unit.

11. The apparatus of claim 1 wherein said discharging and collecting electrodes are negative polarity discharge electrodes.

12. The apparatus of claim 1 wherein said discharge and collecting electrodes are positive polarity discharge electrodes.

13. A method for reducing catalyst particulate contamination in a flowing gas stream containing particulates wherein said gas is passed through an electrostatic precipitator which method comprises:

i) passing said gas by a discharge electrode thereby electrically charging said particulates;

ii) capturing said charged particulates on a particulate collecting means, proximal to said discharge electrode, which comprises outer and inner concentric, nestable, relatively rotatable, semi-tubes, arrayed in an open, nested configuration, said inner semi-tube having a concave surface exposed to the flow of said gas, acting as a collecting electrode which is oppositely charged from said discharge electrode until a desired amount of particulates have been collected;

iii) rotating said semi-tubes to a substantially enclosed tube configuration having an interior which is not substantially exposed to the flow of said gas, said configuration having a lower end which communicates with a particulate collection receptacle;

iv) subjecting said collecting electrode to forces which detach said particulates from said collecting electrode, said particulates dropping into a particulate collection receptacle from which they can be removed; and v) rotating said semi-tubes from said enclosed tube configuration to said open, nested configuration; and vi) withdrawing a gas stream of reduced particulate contamination.

14. The method of claim 13 wherein said outer and inner concentric, nestable, semi-tubes are substantially vertically disposed.

15. The method of claim 13 wherein said outer semi-tube is fixed and said inner semi-tube is moveable.

16. The method of claim 13 wherein said particulates are detached from said collecting electrode by application of mechanical force.

17. The method of claim 13 wherein said particulates are detached from said collecting electrode by application of sonic energy.

18. The method of claim 13 wherein said voltage applied to said collector electrode is interrupted during detaching of particulates therefrom.

19. The method of claim 13 wherein said gaseous stream is a flue gas from a fluidized catalytic cracking unit.

20. The method of claim 13 wherein said discharging and collecting electrodes are negative polarity discharge electrodes.

* * * * *